US009234404B2

(12) United States Patent
Felten

(10) Patent No.: US 9,234,404 B2
(45) Date of Patent: Jan. 12, 2016

(54) DOWNHOLE FLUID FLOW CONTROL SYSTEM AND METHOD HAVING A FLUIDIC MODULE WITH A FLOW CONTROL TURBINE

(71) Applicant: Halliburton Energy Services, Inc., Houston, TX (US)

(72) Inventor: Frederic Felten, Corinth, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 459 days.

(21) Appl. No.: 13/688,391

(22) Filed: Nov. 29, 2012

(65) Prior Publication Data

US 2013/0220633 A1 Aug. 29, 2013

(51) Int. Cl.

| | |
|---|---|
| ***E21B 34/06*** | (2006.01) |
| ***E21B 43/08*** | (2006.01) |
| ***E21B 43/12*** | (2006.01) |

(52) U.S. Cl.

CPC ..... *E21B 34/06* (2013.01); *E21B 43/08* (2013.01); *E21B 43/12* (2013.01)

(58) Field of Classification Search

CPC ..... E21B 41/0085; H02P 2101/10; H02K 7/1823

See application file for complete search history.

(56) References Cited

U.S. PATENT DOCUMENTS

| | | | | |
|---|---|---|---|---|
| 4,488,055 | A * | 12/1984 | Toyama | 290/53 |
| 4,740,711 | A * | 4/1988 | Sato et al. | 290/52 |
| 5,839,508 | A * | 11/1998 | Tubel et al. | 166/65.1 |
| 6,518,680 | B2 * | 2/2003 | McDavid, Jr. | 290/54 |
| 7,165,608 | B2 * | 1/2007 | Schultz et al. | 166/66.5 |
| 7,190,084 | B2 * | 3/2007 | Hall et al. | 290/1 R |
| 7,537,051 | B1 * | 5/2009 | Hall et al. | 166/65.1 |
| 8,581,427 | B2 * | 11/2013 | Schoonover | 290/1 R |
| 8,905,144 | B2 * | 12/2014 | Dykstra et al. | 166/373 |
| 8,957,538 | B2 * | 2/2015 | Inman et al. | 290/52 |
| 8,967,267 | B2 * | 3/2015 | Dykstra et al. | 166/319 |
| 2004/0000349 | A1 | 1/2004 | Cull et al. | |
| 2005/0012340 | A1 * | 1/2005 | Cousins | 290/52 |
| 2005/0051323 | A1 * | 3/2005 | Fripp et al. | 166/65.1 |
| 2008/0047753 | A1 | 2/2008 | Hall et al. | |
| 2011/0198097 | A1 * | 8/2011 | Moen | E21B 34/08 166/373 |
| 2011/0297384 | A1 | 12/2011 | Fripp et al. | |
| 2011/0297385 | A1 | 12/2011 | Dykstra et al. | |
| 2012/0091732 | A1 * | 4/2012 | Fallet et al. | 290/40 R |
| 2013/0112423 | A1 * | 5/2013 | Dykstra et al. | 166/373 |

OTHER PUBLICATIONS

ISRWO, International Searching Authority—KIPO, PCT/2012/027076, Nov. 7, 2012.

* cited by examiner

*Primary Examiner* — Blake Michener

(57) ABSTRACT

A downhole fluid flow control system includes a fluidic module having a turbine chamber. A flow control turbine is rotatably disposed within the turbine chamber. The flow control turbine is operable to provide fluid discriminating flow resistance such that a pressure drop for a desired production fluid passing through the fluidic module is less than a pressure drop for an undesired production fluid passing through the fluidic module. For example, the flow control turbine is operable generate a greater pressure drop in water produced therethrough as compared to oil produced therethrough due to differences in the density, viscosity or other property of the produced fluid.

15 Claims, 8 Drawing Sheets

DOWNHOLE FLUID FLOW CONTROL SYSTEM AND METHOD HAVING A FLUIDIC MODULE WITH A FLOW CONTROL TURBINE

CROSS-REFERENCE TO RELATED APPLICATIONS

This application claims the benefit under 35 U.S.C. §119 of the filing date of International Application No. PCT/US2012/027076, filed Feb. 29, 2012. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole fluid flow control system and method that are operable to control the inflow of formation fluids with a fluidic module having a flow control turbine.

BACKGROUND OF THE INVENTION

Without limiting the scope of the present invention, its background will be described with reference to producing fluid from a hydrocarbon bearing subterranean formation, as an example. During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screen assemblies positioned proximate the desired production interval or intervals. In other completions, to control the flowrate of production fluids into the production tubing, it is common practice to install one or more flow control devices within the tubing string.

Attempts have been made to utilize fluid flow control devices within completions requiring sand control. For example, in certain sand control screen assemblies, after production fluids flow through the filter medium, the fluids are directed into a flow control section. The flow control section may include one or more flow control components such as flow tubes, nozzles, labyrinths or the like. Typically, the production flowrate through these flow control screens is fixed prior to installation by the number and design of the flow control components.

It has been found, however, that due to changes in formation pressure and changes in formation fluid composition over the life of the well, it may be desirable to adjust the flow control characteristics of the flow control sections. In addition, for certain completions, such as long horizontal completions having numerous production intervals, it may be desirable to independently control the inflow of production fluids into each of the production intervals. Further, in some completions, it would be desirable to adjust the flow control characteristics of the flow control sections without the requirement for well intervention.

Accordingly, a need has arisen for a flow control screen that is operable to control the inflow of formation fluids in a completion requiring sand control. A need has also arisen for flow control screens that are operable to independently control the inflow of production fluids from multiple production intervals. Further, a need has arisen for such flow control screens that are operable to control the inflow of production fluids without the requirement for well intervention as the composition of the fluids produced into specific intervals changes over time.

SUMMARY OF THE INVENTION

The present invention disclosed herein comprises a downhole fluid flow control system for controlling fluid production in completions that may require sand control. In addition, the downhole fluid flow control system of the present invention is operable to independently control the inflow of production fluids into multiple production intervals without the requirement for well intervention as the composition of the fluids produced into specific intervals changes over time.

In one aspect, the present invention is directed to a downhole fluid flow control system. The system includes a fluidic module having a turbine chamber. A flow control turbine is rotatably disposed within the turbine chamber. The flow control turbine is operable to provide fluid discriminating flow resistance such that a pressure drop for a desired production fluid passing through the fluidic module is less than a pressure drop for an undesired production fluid passing through the fluidic module.

In one embodiment, the fluid discriminating flow resistance of the flow control turbine may be responsive to fluid viscosity. In another embodiment, the fluid discriminating flow resistance of the flow control turbine may be responsive to fluid density. In certain embodiments, the flow control turbine may be a single stage turbine. In other embodiments, the flow control turbine may be a multi stage turbine. In some embodiments, the flow control turbine may include a rotor and a stator. In these embodiments, the flow control turbine may be operable to generate electricity. In one embodiment, the production fluid may enter the turbine chamber substantially parallel to the axis of rotation of the flow control turbine. In another embodiment, the production fluid may enter the turbine chamber substantially perpendicular to the axis of rotation of the flow control turbine. In some embodiments, the desired production fluid may be oil and the undesired production fluid may be water. In other embodiments, the desired production fluid may be oil and the undesired production fluid may be gas. In further embodiments, the desired production fluid may be gas and the undesired production fluid may be water.

In another aspect, the present invention is directed to a flow control screen. The flow control screen includes a base pipe with an internal passageway. A filter medium is positioned around the base pipe. A housing is positioned around the base pipe defining a fluid flow path between the filter medium and the internal passageway. At least one fluidic module is disposed within the fluid flow path. The fluidic module has a turbine chamber with a flow control turbine rotatably disposed therein. The flow control turbine is operable to provide fluid discriminating flow resistance such that a pressure drop for a desired production fluid passing through the fluidic module is less than a pressure drop for an undesired production fluid passing through the fluidic module.

In one embodiment, the flow control screen may include first and second fluidic modules in series with one another. In this embodiment, the first fluidic module may include the flow control turbine and the second fluidic module may include a vortex chamber. Also, in this embodiment, the flow control screen may include a plurality of first fluidic modules and a plurality of second fluidic modules.

In a further aspect, the present invention is directed to a downhole fluid flow control method. The method includes positioning a fluid flow control system at a target location downhole, the fluid flow control system including a fluidic module having a turbine chamber with a flow control turbine rotatably disposed therein; producing a desired fluid through the fluidic module; generating a first pressure drop responsive to production of the desired fluid; producing an undesired fluid through the fluidic module; and generating a second pressure responsive to production of the undesired fluid, the second pressure drop being higher than the first pressure drop, thereby providing fluid discriminating flow resistance.

The method may also include generating electricity with the flow control turbine responsive to producing fluid through the fluidic module and operating a downhole device with the electricity generated by the flow control turbine including increasing flow resistance on the production fluid.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
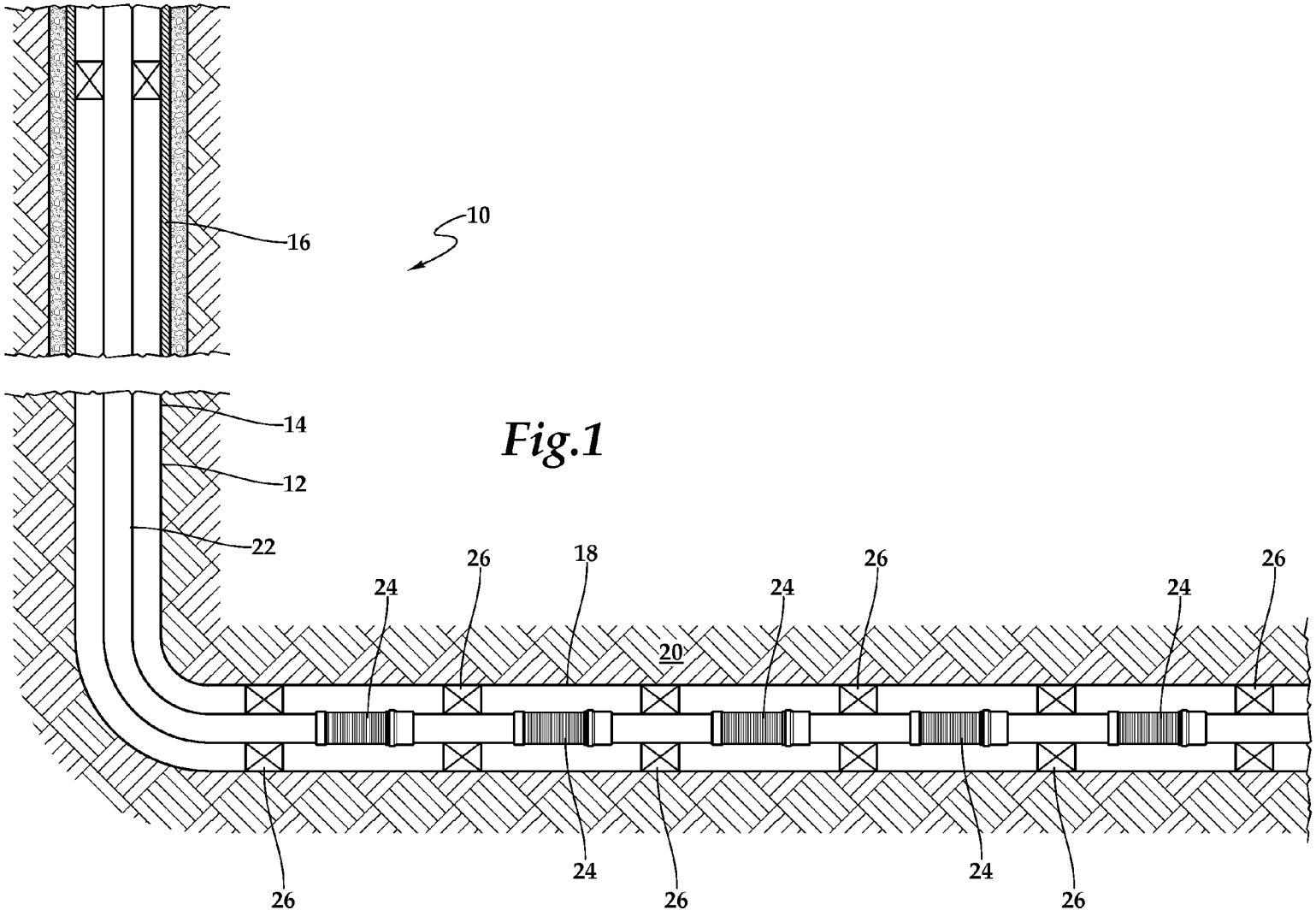
FIG. 1 is a schematic illustration of a well system operating a plurality of flow control screens according to an embodiment of the present invention.

Referring initially to FIG. 1, therein is depicted a well system including a plurality of downhole fluid flow control systems positioned in flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of annular barriers depicted as packers 26 that provides a fluid seal between the completion string and wellbore 12, thereby defining the production intervals. In the illustrated embodiment, flow control screens 24 serve the function of filtering particulate matter out of the production fluid stream. Each flow control screen 24 also has a flow control section that is operable to control fluid flow therethrough.

For example, the flow control sections may be operable to control flow of a production fluid stream during the production phase of well operations. Alternatively or additionally, the flow control sections may be operable to control the flow of an injection fluid stream during a treatment phase of well operations. As explained in greater detail below, the flow control sections preferably control the inflow of production fluids over the life of the well into each production interval without the requirement for well intervention as the composition of the fluids produced into specific intervals changes over time in order to maximize production of a desired fluid such as oil and minimize production of an undesired fluid such as water or gas.

Even though FIG. 1 depicts the flow control screens of the present invention in an open hole environment, it should be understood by those skilled in the art that the present invention is equally well suited for use in cased wells. Also, even though FIG. 1 depicts one flow control screen in each production interval, it should be understood by those skilled in the art that any number of flow control screens of the present invention may be deployed within a production interval without departing from the principles of the present invention. In addition, even though FIG. 1 depicts the flow control screens of the present invention in a horizontal section of the wellbore, it should be understood by those skilled in the art that the present invention is equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Further, even though FIG. 1 depicts the flow control components associated with flow control screens in a tubular string, it should be understood by those skilled in the art that the flow control components of the present invention need not be associated with a flow control screen or be deployed as part of the tubular string. For example, one or more flow control components may be deployed and removably inserted into the center of the tubing string or side pockets of the tubing string.

Figure 2A:
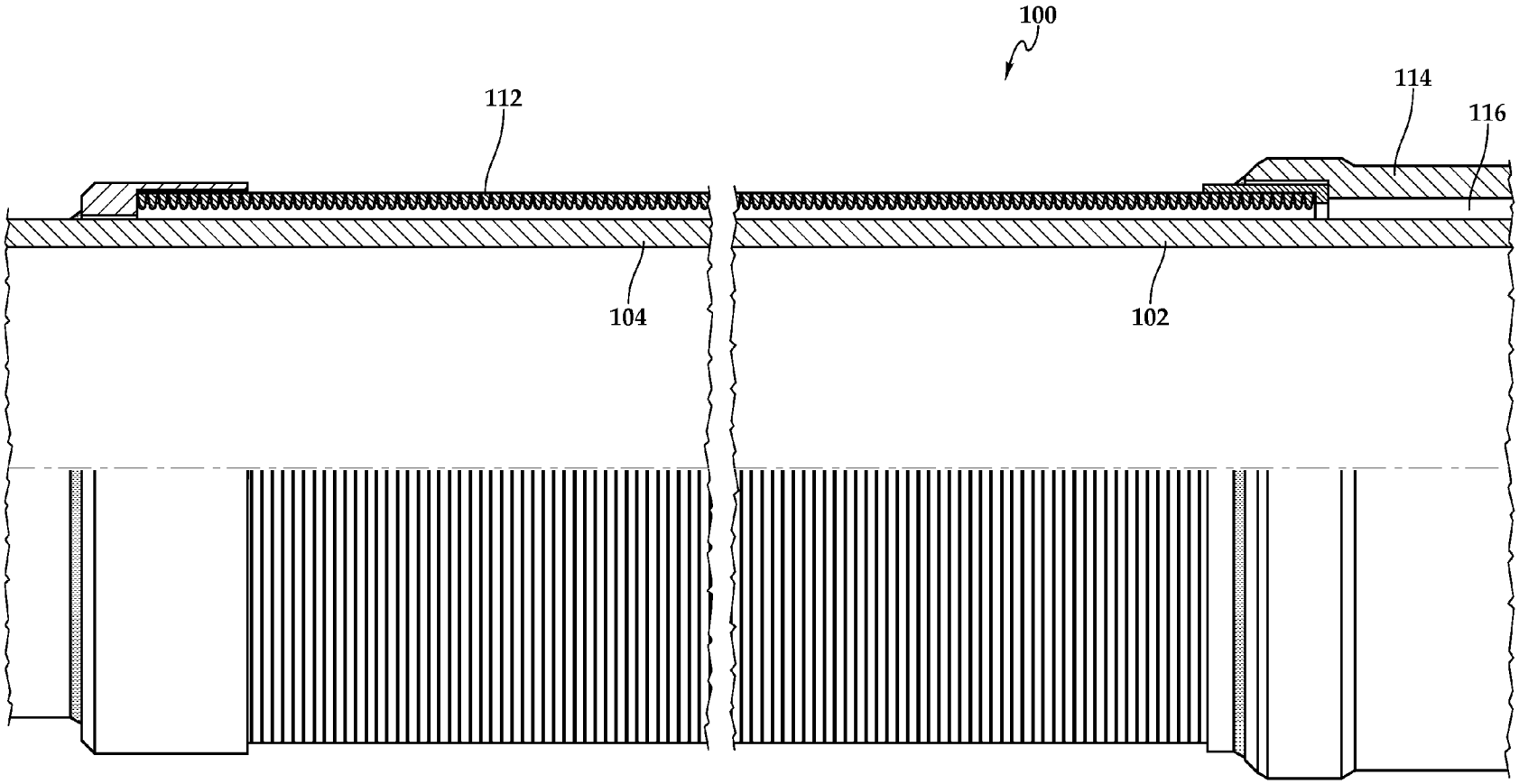
FIGS. 2A-2B are quarter sectional views of successive axial sections of a downhole fluid flow control system embodied in a flow control screen according to an embodiment of the present invention.
Figure 2B:
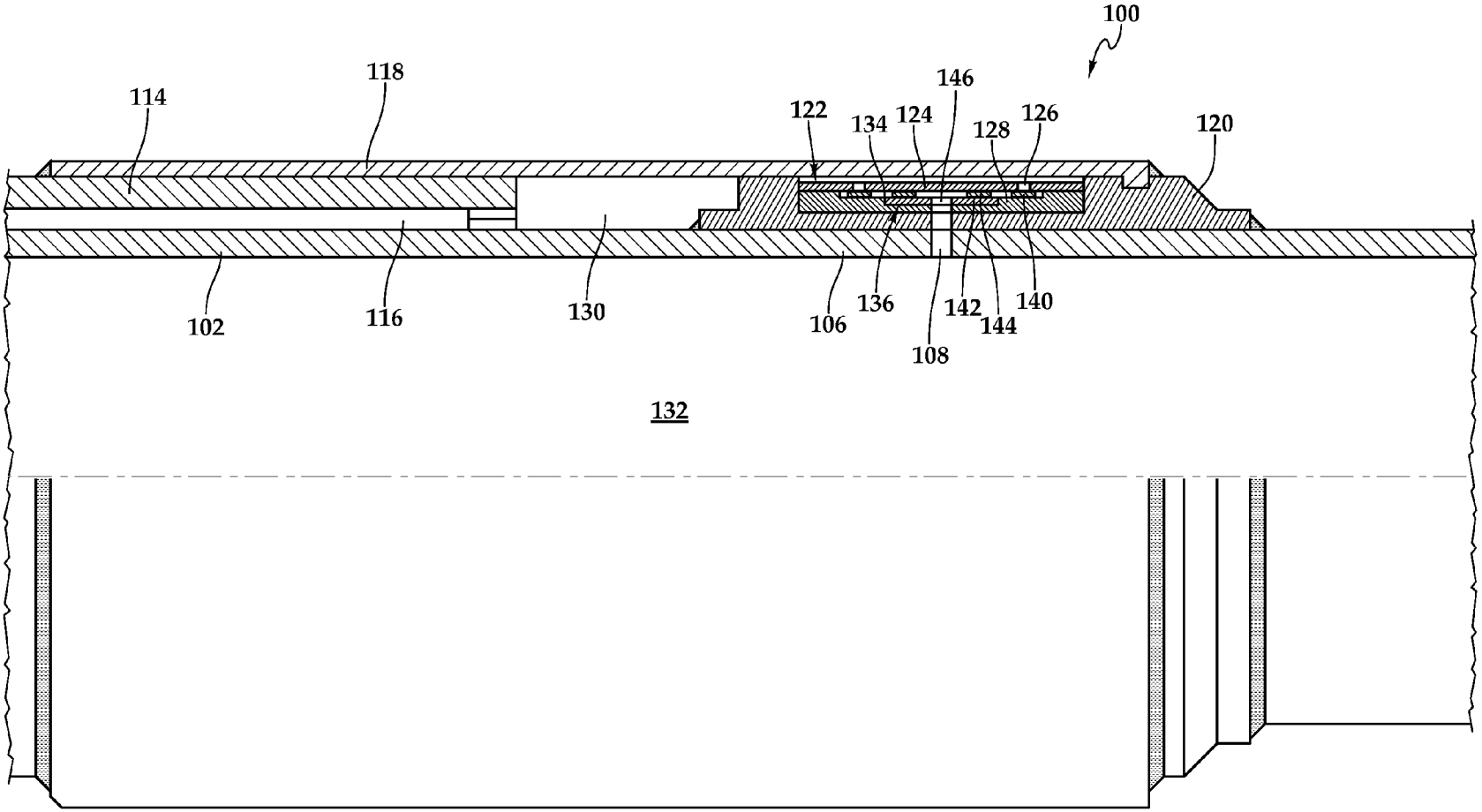

Referring next to FIGS. 2A-2B, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including one or more production ports 108. Positioned around an uphole portion of blank pipe section 104 is a screen element depicted as filter medium 112, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those skilled in the art that the present invention does not need to have a filter medium associated therewith, accordingly, the exact design of the filter medium is not critical to the present invention.

Positioned downhole of filter medium 112 is a screen interface housing 114 that forms a passageway depicted as annulus 116 with base pipe 102. Securably connected to the downhole end of screen interface housing 114 is a flow control housing 118. At its downhole end, flow control housing 118 is securably connected to a support assembly 120 which is securably coupled to base pipe 102. The various connections of the components of flow control screen 100 may be made in any suitable fashion including welding, threading and the like as well as through the use of fasteners such as pins, set screws and the like. Positioned between support assembly 120 and flow control housing 118 are one or more flow control components depicted as fluidic modules 122, only one of which is visible in FIG. 2B. Fluidic modules 122 may be circumferentially distributed about base pipe 102 at uniform intervals such as one hundred and eighty degrees, one hundred and twenty degrees, ninety degrees or other interval. Even though a particular arrangement of flow control components has been described, it should be understood by those skilled in the art that other numbers and arrangements of flow control components may be used. For example, either a greater or lesser number of circumferentially distributed flow control components at uniform or nonuniform intervals may be used. Additionally or alternatively, flow control components may be longitudinally distributed along base pipe 102.

As discussed in greater detail below, fluidic modules 122 are operable to control the inflow of formation fluid therethrough. For example, during the production phase of well operations, fluid flows from the formation into the production tubing through fluid flow control screen 100. The production fluid, after being filtered by filter medium 112, if present, flows into annulus 116. The fluid then travels into an annular region 130 between base pipe 102 and flow control housing 118 before entering the flow control section as further described below. The fluid then enters one or more inlets of fluidic modules 122 where the desired flow control operation occurs depending upon the composition of the produced fluid. For example, if a desired fluid is produced, flow through fluidic modules 122 encounters a relatively low resistance. If an undesired fluid is produced, flow through fluidic modules 122 encounters a relatively high resistance. After passing through fluidic modules 122, the fluid is discharged through openings 108 to interior flow path 132 of base pipe 102 for production to the surface.

Figure 3A:
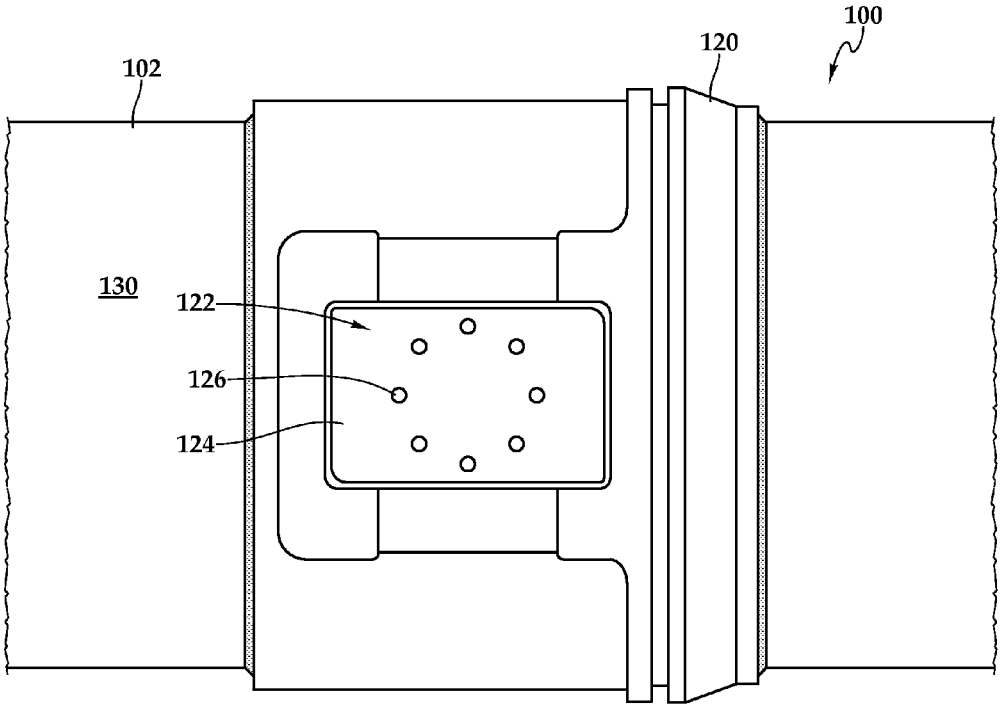
FIGS. 3A-3B are top views of the flow control section of a flow control screen with certain components removed according to an embodiment of the present invention.
Figure 3B:
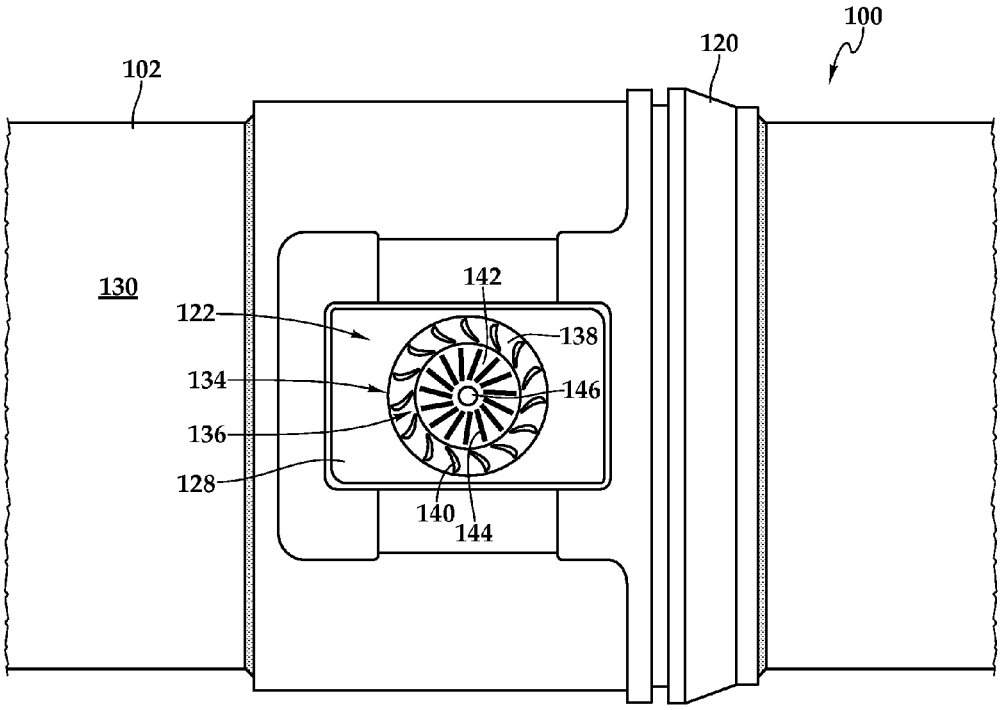

Referring additionally to FIGS. 3A-3B, the flow control section of flow control screen 100 is representatively illustrated. In the illustrated portion, flow control housing 118 has been removed to aid in describing the present invention. Support assembly 120 is securably coupled to base pipe 102. Support assembly 120 is operable to receive and support any number of fluidic modules 122, only one being visible in the figures. The illustrated fluidic module 122 is formed form an upper fluidic element 124 (removed in FIG. 3B to aid in describing the present invention) that includes a plurality of inlet ports 126 and a lower fluidic element 128. Together, upper fluidic element 124 and lower fluidic element 128 form a turbine chamber 134. A flow control turbine 136 is disposed within turbine chamber 134. In the illustrated embodiment, flow control turbine 136 includes a guide assembly 138 having a plurality of fluid guides 140 that are substantially radially aligned with inlet ports 126 of upper fluidic element 124. Flow control turbine 136 also includes a rotor assembly 142 that is operable to rotate relative to the other components of fluidic module 122 including guide assembly 138. Rotor assembly 142 includes a plurality of blades 144 and an outlet port 146 which is circumferentially and longitudinally aligned with an opening 108 (see FIG. 2B) of base pipe 102.

Blades 144 are designed to provide fluid discriminating flow resistance such that a pressure drop for a desired production fluid passing through fluidic module 122 is less than a pressure drop for an undesired production fluid passing through fluidic module 122. This is achieved based upon blade design parameters including, but not limited to, tip to root twist, camber, thickness distribution, length and count of blades 144 of rotor 142. For example, blades 144 may be tuned to extract more energy out of a low viscosity fluid such as water as compared with a higher viscosity fluid such as oil. Alternatively or additionally, blades 144 may be tuned to extract more energy out of a high density fluid such as water as compared with a lower density fluid such as oil. As another alternative, blades 144 may be tuned to extract more energy out of a low density fluid such as gas as compared with a higher density fluid such as oil or blades 144 may be tuned to extract more energy out of a high density fluid such as water as compared with a lower density fluid such as gas. The amount of energy extracted from the produced fluid is based at least in part on the rotational velocity of rotor 142 which causes resistance to flow between inlet ports 126 and outlet port 146 and the associated pressure drop. In this manner, flow control turbine 136 is operable to create a desired pressure drop in the fluid passing through fluidic module 122 based upon properties of the fluid.

During production, fluid flows from the formation into the production tubing through fluid flow control screens 100 at the various production intervals. The production fluid, after being filtered by filter medium 112, if present, flows into annulus 116. The fluid then travels into an annular region 130 between base pipe 102 and flow control housing 118 before entering the flow control section of a fluid flow control screen 100. The fluid then enters inlet ports 126 of fluidic modules 122 and is directed substantially radially into turbine chamber 134. In the illustrated embodiment, the fluid is traveling substantially parallel to the axis of rotation of rotor 142 and is initially redirected by fluid guides 140 such that the fluid is traveling primarily in a tangentially direction upon impacting blades 144 of rotor 142. The impacting fluid causes rotation of rotor 142 which further enhances the spiral flow. Fluid spiraling around turbine chamber 134 suffers from frictional losses as well as centrifugal losses that impede radial flow toward outlet port 146. Consequently, production fluids passing through fluidic modules 122 encounter resistance and experience the associated pressure drop. After passing through fluidic modules 122, the fluid is discharged through openings 108 to interior flow path 132 of base pipe 102 for production to the surface.

Early in the life of the well, the formation fluids entering the wellbore at the various production intervals are predominately composed of the desired fluid, for example oil. Fluidic modules 122 control the pressure drop of this fluid stream by providing the desired resistance to flow and balancing production along the length of the completion string. As the well ages, however, the composition of the formation fluids will change. For example, an undesired fluid such as water or gas may begin to be produced at certain, but typically not all, of the production intervals. Upon such water or gas breakthrough, the fluidic modules 122 in the affected production intervals autonomously increase the resistance to the flow of the undesired fluid, based upon changes in the targeted fluid property, which reduces the volume of the undesired fluid entering interior passageway 132. In this manner, the flow control characteristics of the flow control screens of the present invention can be autonomously adjusted to enhance production due to the increase in the flow resistance experience by the undesired formation fluids.

Figure 4A:
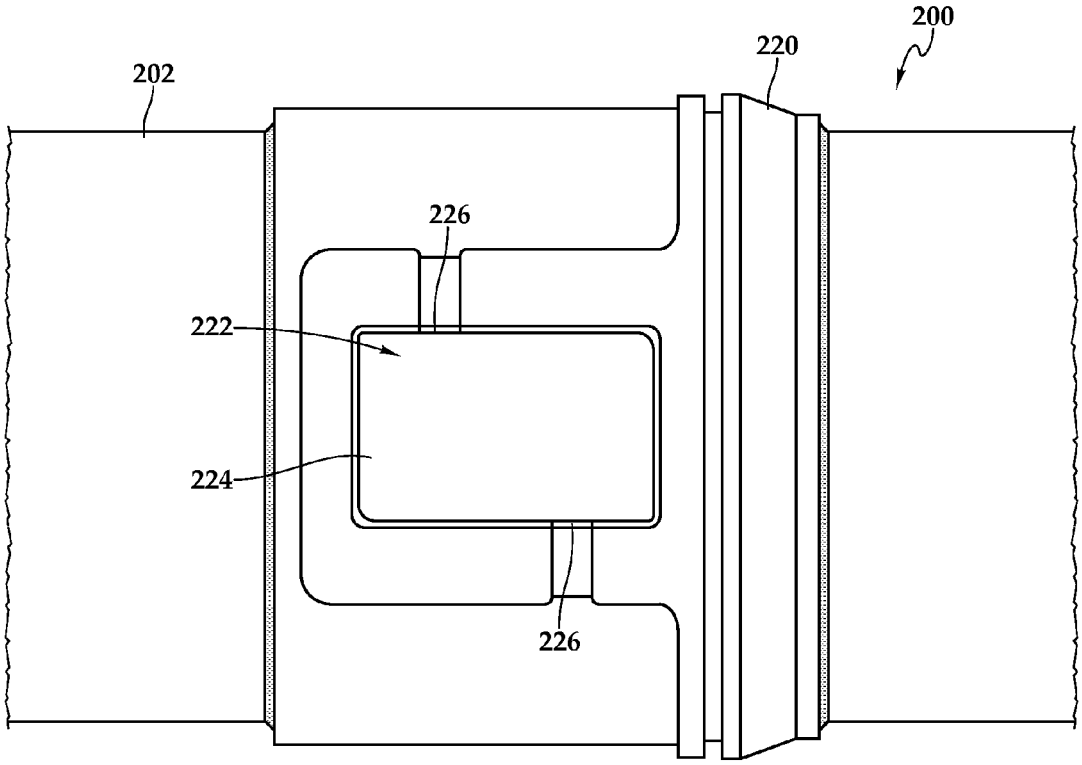
FIGS. 4A-4B are top views of the flow control section of a flow control screen with certain components removed according to an embodiment of the present invention.
Figure 4B:
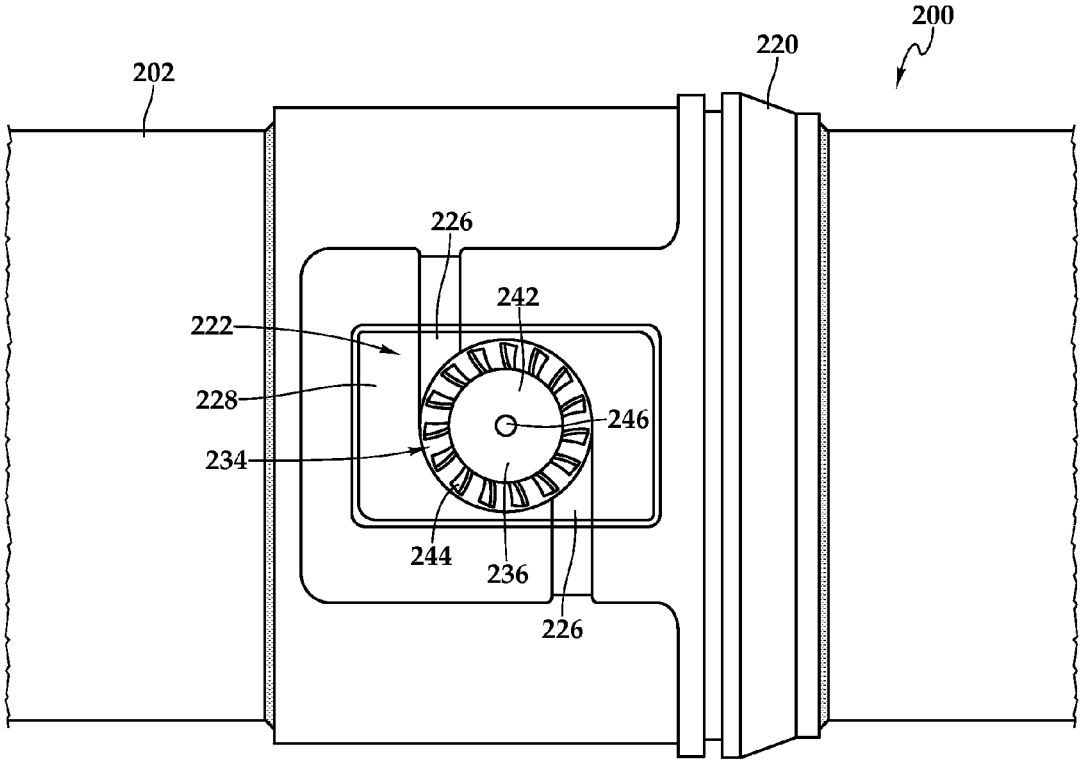

Referring now to FIGS. 4A-4B, the flow control section of flow control screen 200 is representatively illustrated. In the illustrated portion, the flow control housing has been removed to aid in describing the present invention. Support assembly 220 is securably coupled to base pipe 202. Support assembly 220 is operable to receive and support any number of fluidic modules 222, only one being visible in the figures. The illustrated fluidic module 222 is formed form an upper fluidic element 224 (removed in FIG. 4B to aid in describing the present invention) and a lower fluidic element 228. Together, upper fluidic element 224 and lower fluidic element 228 form a turbine chamber 234 having a pair of inlet ports 226. A flow control turbine 236 is disposed within turbine chamber 234. In the illustrated embodiment, flow control turbine 236 includes a rotor assembly 242 that is operable to rotate relative to the other components of fluidic module 222. Rotor assembly 242 includes a plurality of blades 244 and an outlet port 246 which is circumferentially and longitudinally aligned with an opening of base pipe 202.

Blades 244 are designed to provide fluid discriminating flow resistance such that a pressure drop for a desired production fluid passing through fluidic module 222 is less than a pressure drop for an undesired production fluid passing through fluidic module 222. This is achieved based upon blade design parameters including, but not limited to, tip to root twist, camber, thickness distribution, length and count of blades 244 of rotor 242. For example, blades 244 may be tuned to extract more energy out of an undesired fluid such as water or gas as compared with a desired fluid such as oil. The amount of energy extracted from the produced fluid is based at least in part on the rotational velocity of rotor 242 which causes resistance to flow between inlet ports 226 and outlet port 246 and the associated pressure drop. In this manner, flow control turbine 236 is operable to create a desired pressure drop in the fluid passing through fluidic module 222 based upon properties of the fluid.

During production, fluid flows from the formation into the production tubing through fluid flow control screens 200 at the various production intervals. The production fluid, after being filtered by a filter medium, if present, flows in a fluid passageway between the base pipe and a housing before entering the flow control section of a fluid flow control screen 200. The fluid then enters inlet ports 226 of fluidic modules 222 and is directed substantially tangentially into turbine chamber 234. In the illustrated embodiment, the fluid is traveling substantially perpendicularly to the axis of rotation of rotor 242 which causes rotation of rotor 242 and spiral flow of the fluid within turbine chamber 234. Fluid spiraling within turbine chamber 234 suffers from frictional losses, geometrical losses, centrifugal losses and the like that impede radial flow toward outlet port 246. Consequently, production fluids passing through fluidic modules 222 encounter resistance and experience the associated pressure drop. After passing through fluidic modules 222, the fluid is discharged into the interior flow path of base pipe 202 for production to the surface.

Early in the life of the well, the formation fluids entering the wellbore at the various production intervals are predominately composed of the desired fluid, for example oil. Fluidic modules 222 control the pressure drop of this fluid stream by providing the desired resistance to flow and balancing production along the length of the completion string. As the well ages, however, the composition of the formation fluids will change. For example, an undesired fluid such as water or gas may begin to be produced at certain, but typically not all, of the production intervals. Upon such water or gas breakthrough, the fluidic modules 222 in the affected production intervals autonomously increase the resistance to the flow of the undesired fluid, based upon changes in the targeted fluid property, which reduces the volume of the undesired fluid entering the completion string. In this manner, the flow control characteristics of the flow control screens of the present invention can be autonomously adjusted to enhance production due to the increase in the flow resistance experience by the undesired formation fluids.

Figure 5A:
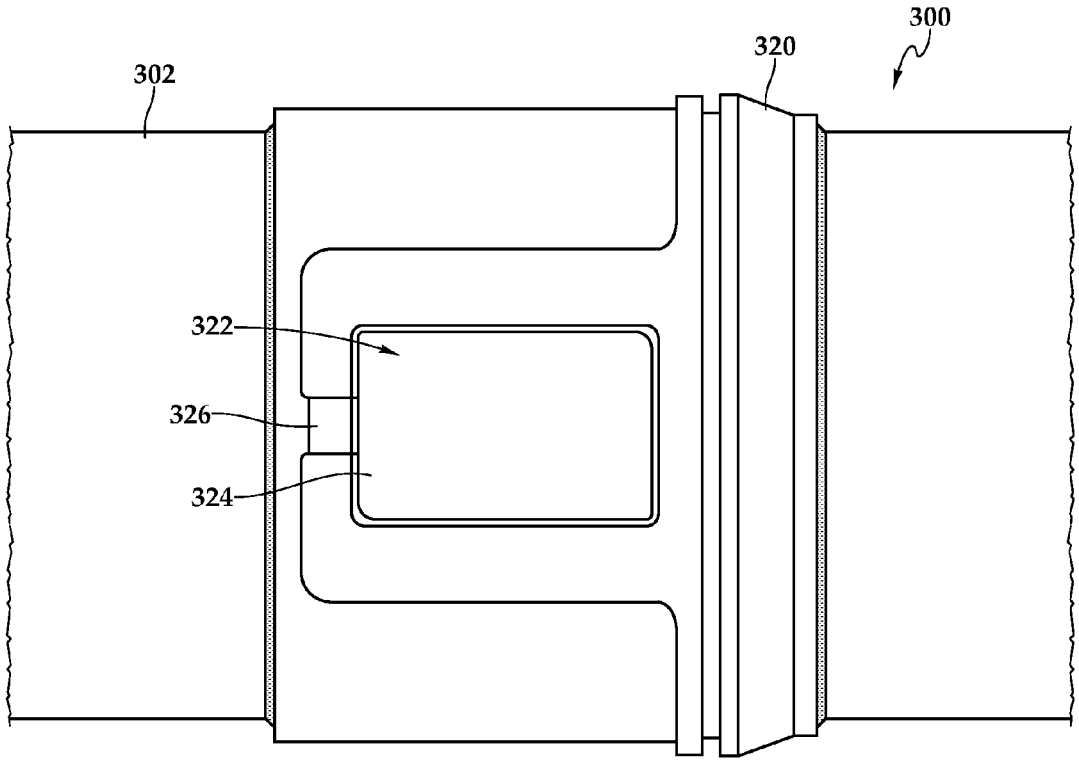
FIGS. 5A-5B are top views of the flow control section of a flow control screen with certain components removed according to an embodiment of the present invention.
Figure 5B:
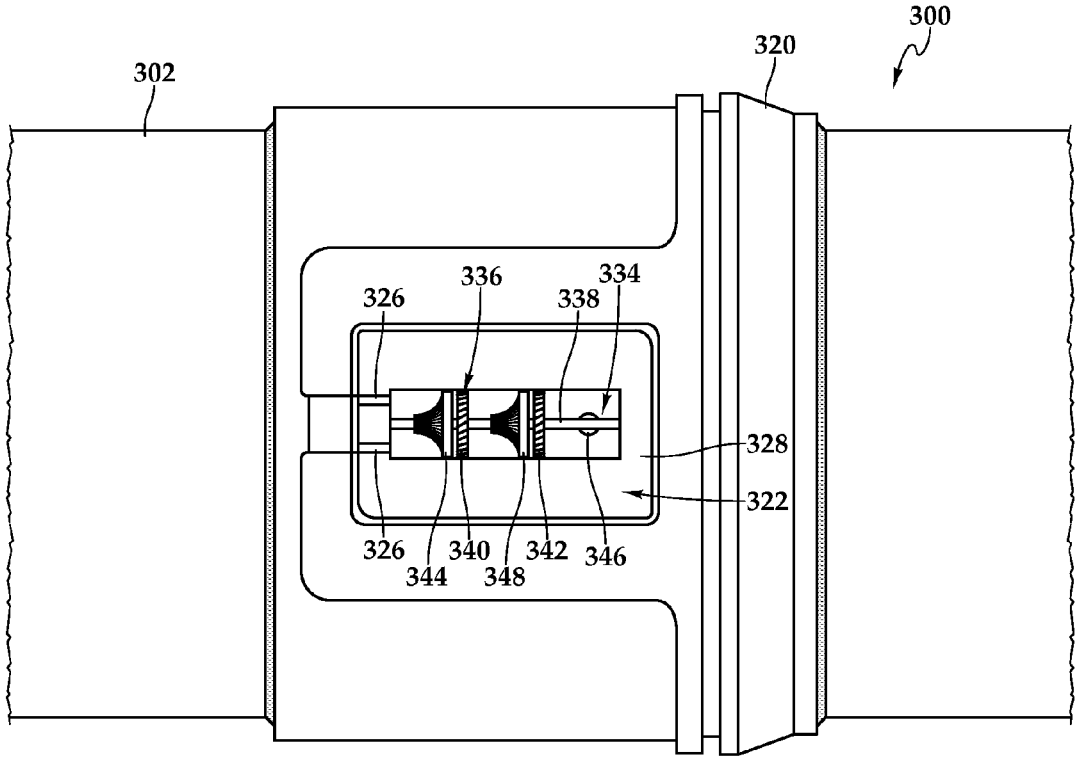

Referring now to FIGS. 5A-5B, the flow control section of flow control screen 300 is representatively illustrated. In the illustrated portion, the flow control housing has been removed to aid in describing the present invention. Support assembly 320 is securably coupled to base pipe 302. Support assembly 320 is operable to receive and support any number of fluidic modules 322, only one being visible in the figures. The illustrated fluidic module 322 is formed form an upper fluidic element 324 (removed in FIG. 5B to aid in describing the present invention) and a lower fluidic element 328. Together, upper fluidic element 324 and lower fluidic element 328 form a turbine chamber 334 having one or more inlet ports 326. A flow control turbine 336 is disposed within turbine chamber 334. In the illustrated embodiment, flow control turbine 336 is a multi stage turbine includes a rotating shaft 338, a pair of rotors 340, 342 each having a plurality of blades and a pair of stators 344, 348. An outlet port 346 that is circumferentially and longitudinally aligned with an opening of base pipe 302, is in fluid communication with turbine chamber 334 downstream of flow control turbine 336.

The blades of rotors 340, 342 are designed to provide fluid discriminating flow resistance such that a pressure drop for a desired production fluid passing through fluidic module 322 is less than a pressure drop for an undesired production fluid passing through fluidic module 322. This is achieved based upon blade design parameters including, but not limited to, tip to root twist, camber, thickness distribution, length and count of the blades of rotors 340, 342. For example, the blades may be tuned to extract more energy out of an undesired fluid such as water or gas as compared with a desired fluid such as oil. The amount of energy extracted from the produced fluid is based at least in part on the rotational velocity of rotors 340, 342 which causes resistance to flow between inlet ports 326 and outlet port 346 and the associated pressure drop. In this manner, flow control turbine 336 is operable to create a desired pressure drop in the fluid passing through fluidic module 322 based upon properties of the fluid. In addition, flow control turbine 336 is operable to generate an electrical current due to the rotation of rotors 340, 342 relative to stators 344, 348 when the appropriate magnetic field is developed. The electrical current may be passed through electrical circuitry (not pictured) to provide electricity to other components in the well or may be stored in one or more batteries (not pictured).

During production, fluid flows from the formation into the production tubing through fluid flow control screens 300 at the various production intervals. The production fluid, after being filtered by a filter medium, if present, flows in a fluid passageway between the base pipe and a housing before entering the flow control section of a fluid flow control screen 300. The fluid then enters inlet ports 326 of fluidic modules 322 and is directed into turbine chamber 334. In the illustrated embodiment, the fluid is traveling substantially parallel to the axis of rotation of rotor 342 and, upon impact with the blades of rotors 340, 342, causes rotation of rotors 340, 342. Consequently, production fluids passing through fluidic modules 322 encounter resistance and experience the associated pressure drop. After passing through fluidic modules 322, the fluid is discharged into the interior flow path of base pipe 302 for production to the surface.

Early in the life of the well, the formation fluids entering the wellbore at the various production intervals are predominately composed of the desired fluid, for example oil. Fluidic modules 322 control the pressure drop of this fluid stream by providing the desired resistance to flow and balancing production along the length of the completion string. As the well ages, however, the composition of the formation fluids will change. For example, an undesired fluid such as water or gas may begin to be produced at certain, but typically not all, of the production intervals. Upon such water or gas breakthrough, the fluidic modules 322 in the affected production intervals autonomously increase the resistance to the flow of the undesired fluid, based upon changes in the targeted fluid property, which reduces the volume of the undesired fluid entering the completion string. In this manner, the flow control characteristics of the flow control screens of the present invention can be autonomously adjusted to enhance production due to the increase in the flow resistance experience by the undesired formation fluids.

Figure 6A:
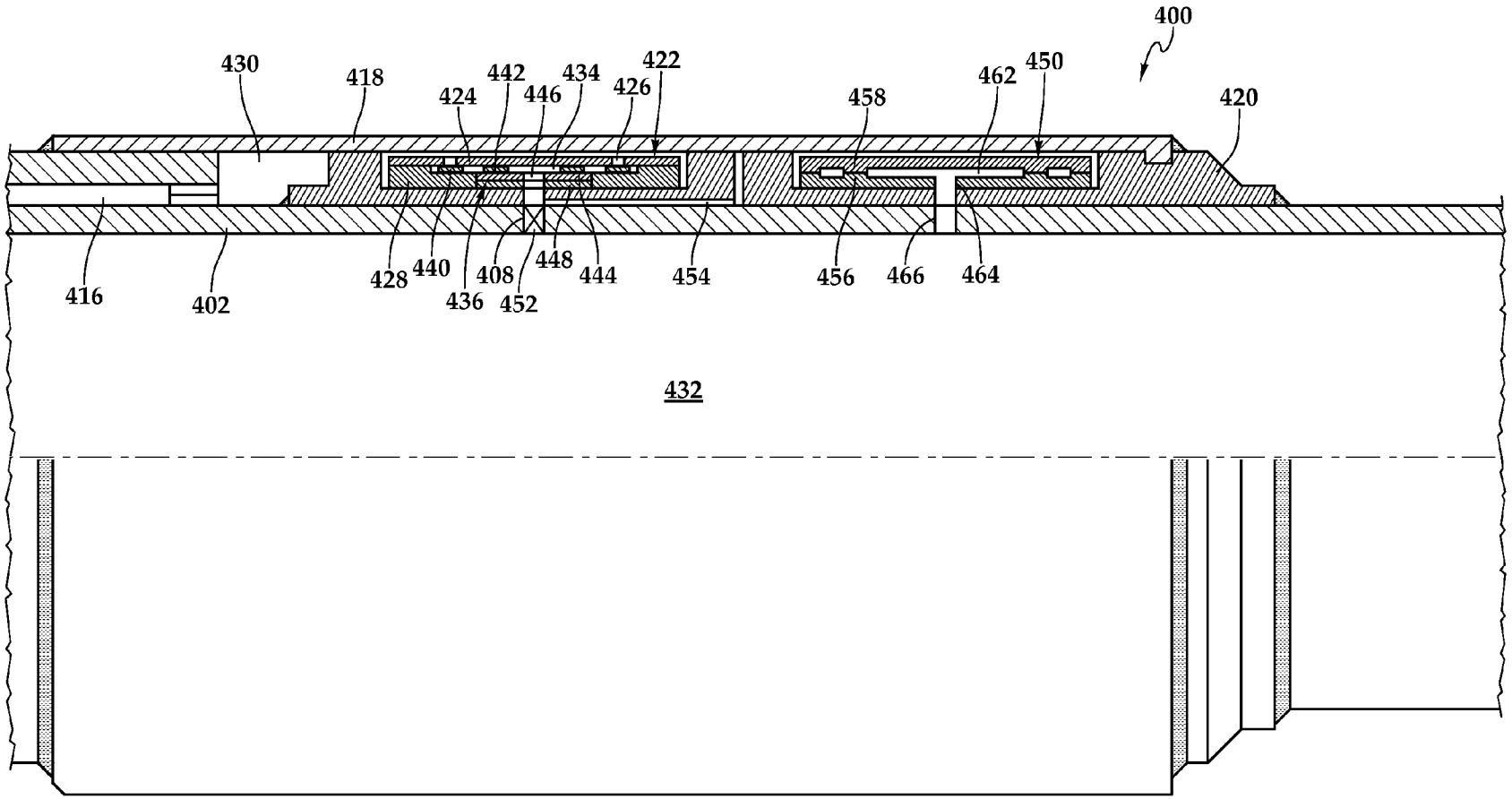
FIG. 6A is a quarter sectional view of the flow control section of a flow control screen according to an embodiment of the present invention.
Figure 6B:
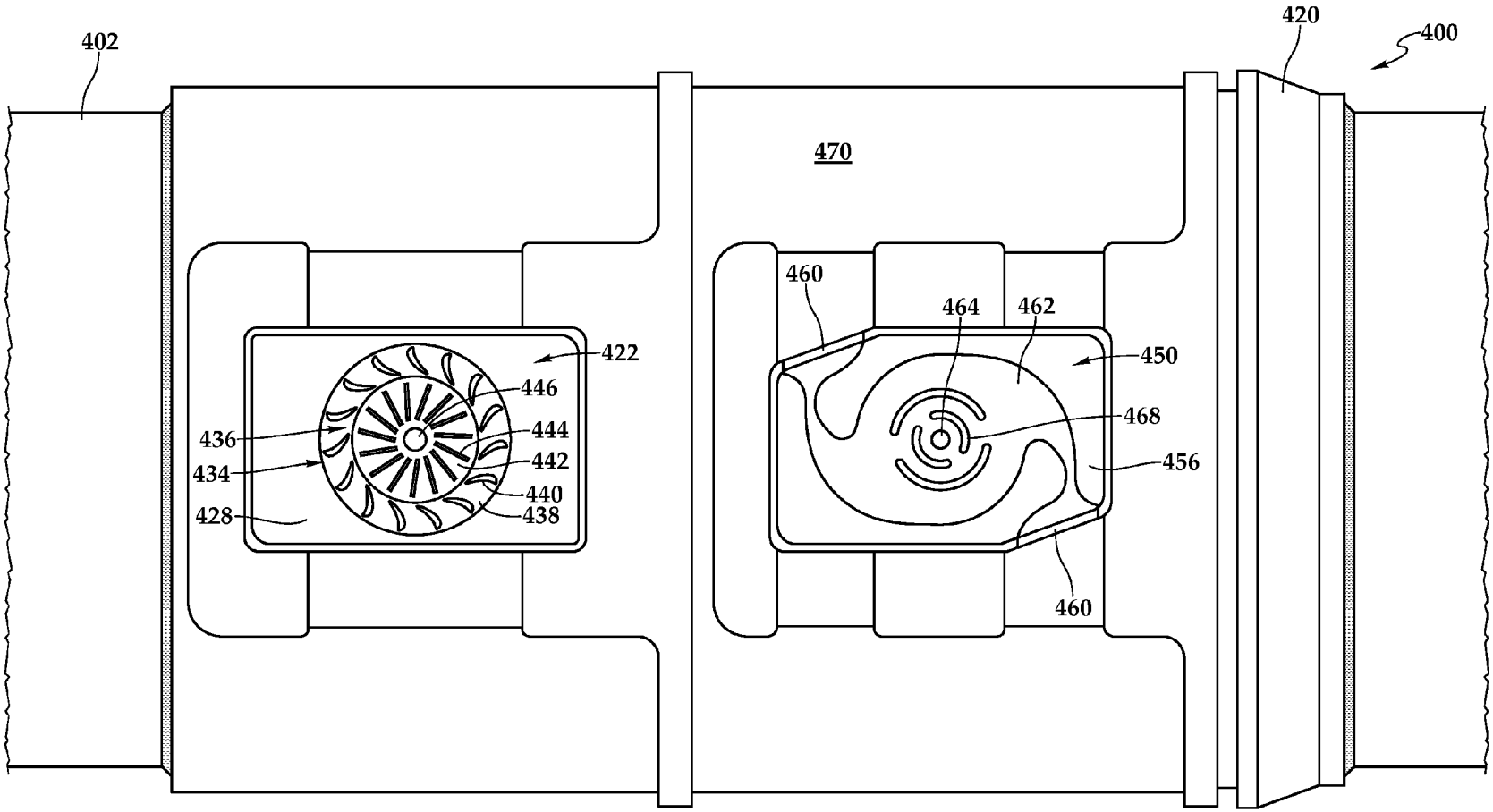
FIG. 6B is a top view of the flow control section of a flow control screen with certain components removed according to an embodiment of the present invention.

Referring now to FIGS. 6A-6B, the flow control section of flow control screen 400 is representatively illustrated. In the illustrated portion, flow control housing 418 has been removed from FIG. 6B to aid in describing the present invention. Support assembly 420 is securably coupled to base pipe 402. Support assembly 420 is operable to receive and support any number of fluidic modules 422, 450, only two being visible in the figures. Fluidic module 422 is formed form an upper fluidic element 424 (removed in FIG. 6B to aid in describing the present invention) that includes a plurality of inlet ports 426 and a lower fluidic element 428. Together, upper fluidic element 424 and lower fluidic element 428 form a turbine chamber 434. A flow control turbine 436 is disposed within turbine chamber 434. In the illustrated embodiment, flow control turbine 436 includes a guide assembly 438 having a plurality of fluid guides 440 that are substantially radially aligned with inlet ports 426 of upper fluidic element 424. Flow control turbine 436 also includes a rotor assembly 442 that is operable to rotate relative to the other components of fluidic module 422 including guide assembly 438 and stator 448. Rotor assembly 442 includes a plurality of blades 444 and an outlet port 446 which is circumferentially and longitudinally aligned with an opening 408 of base pipe 402.

Blades 444 are designed to provide fluid discriminating flow resistance such that a pressure drop for a desired production fluid passing through fluidic module 422 is less than a pressure drop for an undesired production fluid passing through fluidic module 422. This is achieved based upon blade design parameters including, but not limited to, tip to root twist, camber, thickness distribution, length and count of blades 444 of rotor 442. For example, blades 444 may be tuned to extract more energy out of an undesired fluid such as water as compared with a desired fluid such as oil. The amount of energy extracted from the produced fluid is based at least in part on the rotational velocity of rotor 442 which causes resistance to flow between inlet ports 426 and outlet port 446 and the associated pressure drop. In this manner, flow control turbine 436 is operable to create a desired pressure drop in the fluid passing through fluidic module 422 based upon properties of the fluid. In addition, flow control turbine 436 is operable to generate an electrical current due to the rotation of rotor 442 relative to stator 448 or the rotation of rotor 442 relative to stator 448 when the appropriate magnetic field is developed. The electrical current may be passed through electrical circuitry (not pictured) to provide electricity to other components in the well such as one or more valves 452 positioned in openings 408. Alternatively or additionally, the electrical power generated by flow control turbine 436 may be stored in one or more batteries (not pictured).

In the illustrated embodiment, fluidic module 450 is in downstream fluid communication and in series with fluidic module 422 via a fluid passageway 454. Fluidic module 450 is formed from an inner flow control element 456 and an outer flow control element 458, the outer flow control element being removed in FIG. 6B to aid in the description of the present invention. Fluidic module 450 has a fluid flow path including a pair of inlet ports 460, a vortex chamber 462 and an outlet port 464 that is aligned with an opening 466 of base pipe 402. In addition, fluidic module 450 has a plurality of fluid guides 468 in vortex chamber 462. When valves 452 are closed, after fluid is discharged from fluidic modules 422 it travels in fluid passageway 454 and enters annulus 470. The fluid then enters inlet ports 460 of fluidic module 450 and passes through vortex chamber 462 where the desired flow resistance is applied to the fluid flow achieving the desired pressure drop and flowrate therethrough. In the illustrated example, the production fluids entering vortex chamber 462 travel primarily in a tangentially direction and will spiral around vortex chamber 462 with the aid of fluid guides 468 before eventually exiting through port 464. Fluid spiraling around vortex chamber 462 will suffer from frictional losses. Further, the tangential velocity produces centrifugal force that impedes radial flow. Consequently, production fluids passing through fluidic module 450 encounter significant resistance. Exiting fluid is discharged through opening 464 to the interior passageway 432 of base pipe 402 for production to the surface.

During production, fluid flows from the formation into the production tubing through fluid flow control screens 400 at the various production intervals. The production fluid, after being filtered by a filter medium, if present, flows into annulus 416. The fluid then travels into an annular region 430 between base pipe 402 and flow control housing 418 before entering the flow control section of a fluid flow control screen 400. The fluid then enters inlet ports 426 of fluidic modules 422 and is directed substantially radially into turbine chamber 434. In the illustrated embodiment, the fluid is traveling substantially parallel to the axis of rotation of rotor 442 and is initially redirected by fluid guides 440 such that the fluid is traveling primarily in a tangentially direction upon impacting blades 444 of rotor 442. The impacting fluid causes rotation of rotor 442 which further enhances the spiral flow. Fluid spiraling around turbine chamber 434 suffers from frictional losses as well as centrifugal losses that impede radial flow toward outlet port 446. Consequently, production fluids passing through fluidic modules 422 encounter resistance and experience the associated pressure drop. After passing through fluidic modules 422, the fluid may be discharged through openings 408 to interior flow path 432 of base pipe 402 for production to the surface.

Early in the life of the well, the formation fluids entering the wellbore at the various production intervals are predominately composed of the desired fluid, for example oil. Fluidic modules 422 control the pressure drop of this fluid stream by providing the desired resistance to flow and balancing production along the length of the completion string. During this stage of well operations, valves 452 are preferably open such that fluid flow from fluidic modules 422 may pass directly into the completion string via openings 408. As the well ages, however, the composition of the formation fluids will change. For example, an undesired fluid such as water or gas may begin to be produced at certain, but typically not all, of the production intervals. Upon such water or gas breakthrough, the fluidic modules 422 in the affected production intervals autonomously increase the resistance to the flow of the undesired fluid, based upon changes in the targeted fluid property, which reduces the volume of the undesired fluid entering interior passageway 432 of the completion string.

In addition, the increased energy produced by the change in fluid composition may be used as a signal to close valves 452. For example, electrical energy generated by flow control turbine 436 that was previously stored in a battery (not pictured) or currently being generated may be used to operate an actuator (not pictured) to shift valves 452 from the open position to the closed position. Thereafter, fluid discharged from fluidic modules 422 travels in fluid passageway 454 and enters fluidic modules 450. As discussed above, the fluid then enters inlet ports 460 of fluidic modules 450 and passes through vortex chambers 462 where the desired flow resistance is applied to the fluid flow achieving the desired pressure drop and flowrate therethrough. Consequently, production fluids passing through fluidic modules 450 encounter significant resistance. Thereafter, the fluid is discharged through openings 464 to the interior passageway 432 of base pipe 402 for production to the surface. In this manner, the undesired fluid not only encounters increased flow resistance through fluidic modules 422, but must also proceed in series through fluidic modules 450. As such, the flow control characteristics of flow control screens 400 of the present invention can be autonomously adjusted to enhance production due to the increase in the flow resistance experience by the undesired formation fluids.

While a particular fluid flow resistor having a vortex chamber has been described as being positioned in series with fluidic modules 422, it is to be clearly understood that other types and combinations of fluid flow resistors may be used to achieve the desired fluid flow control without departing from the principles of the present invention, such fluid flow resistors including, but not limited to, flow tubes or other tortuous path flow resistors, fluidic diodes having configurations other than vortex chambers, matrix chambers wherein a chamber contains beads or other fluid flow resisting filler material or fluid selectors that include a material that swells when it comes in contact with the undesired fluid including materials that are swellable in response to stimulants such as pH, ionic concentration or the like.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A flow control screen comprising:

a base pipe with an internal passageway;

a filter medium positioned around the base pipe;

a housing positioned around the base pipe defining an annular fluid flow path between the filter medium and an exterior surface of the base pipe;

an opening formed through said base pipe fluidly coupling said annular fluid flow path with said internal passageway; and at least one fluidic module disposed within the annular fluid flow path, the fluidic module having a turbine chamber with a flow control turbine rotatably disposed therein, the flow control turbine operable to provide fluid discriminating flow resistance such that a pressure drop for a desired production fluid passing through the fluidic module is less than a pressure drop for an undesired production fluid passing through the fluidic module.

2. The flow control screen as recited in claim 1 wherein the flow control turbine further comprises a single stage turbine.

3. The flow control screen as recited in claim 1 wherein the flow control turbine further comprises a multi stage turbine.

4. The flow control screen as recited in claim 1 wherein the flow control turbine further comprises a rotor and a stator.

5. The flow control screen as recited in claim 1 further comprising an electrically-operated inflow valve fluidly coupled within said fluid flow path and electrical generator mechanically coupled to said flow control turbine and electrically coupled to said inflow valve.

6. The flow control screen as recited in claim 1 wherein the production fluid enters the turbine chamber substantially parallel to a plane of rotation of the flow control turbine.

7. The flow control screen as recited in claim 1 wherein the production fluid enters the turbine chamber substantially perpendicular to a plane of rotation of the flow control turbine.

8. The flow control screen as recited in claim 1 wherein the desired production fluid is selected from oil and gas.

9. The flow control screen as recited in claim 1 further comprising first and second fluidic modules in series with one another.

10. The flow control screen as recited in claim 9 wherein the first fluidic module includes the flow control turbine and wherein the second fluidic module includes a vortex chamber.

11. The flow control screen as recited in claim 1 wherein the undesired production fluid is selected from gas and water.

12. The flow control screen as recited in claim 1 wherein:

said base pipe is disposed within a wellbore; and said internal passageway is fluidly coupled to an interior of a tubing string extending to the surface.

13. A downhole fluid flow control method comprising:

positioning a fluid flow control system at a target location within a wellbore, the fluid flow control system including a base pipe disposed within a housing so as to define an annular fluid flow path between the base pipe and the housing, a fluidic module having a turbine chamber with a flow control turbine rotatably disposed within said annular flow path;

producing a desired fluid through the fluidic module into said base pipe and to a surface of the wellbore;

generating a first pressure drop responsive to production of the desired fluid;

producing an undesired fluid through the fluidic module; and generating a second pressure drop responsive to production of the undesired fluid, the second pressure drop being higher than the first pressure drop, thereby providing fluid discriminating flow resistance.

14. The method as recited in claim 13 further comprising generating electricity with the flow control turbine responsive to producing fluid through the fluidic module.

15. The method as recited in claim 14 further comprising operating an inflow valve fluidly coupled to said turbine chamber with the electricity generated by the flow control turbine.

* * * * *